US009528227B2

(12) United States Patent
Kraemer

(10) Patent No.: US 9,528,227 B2
(45) Date of Patent: Dec. 27, 2016

(54) WATER COOLING SYSTEM FOR GRINDER BLADES

(75) Inventor: Terrence L. Kraemer, St. Cloud, MN (US)

(73) Assignee: Diamond Surface, Inc., Rogers, MN (US)

( * ) Notice: Subject to any disclaimer, the term of this patent is extended or adjusted under 35 U.S.C. 154(b) by 410 days.

(21) Appl. No.: 12/533,591

(22) Filed: Jul. 31, 2009

(65) Prior Publication Data

US 2010/0109421 A1 May 6, 2010

Related U.S. Application Data

(60) Provisional application No. 61/085,753, filed on Aug. 1, 2008.

(51) Int. Cl.
*E01C 23/08* (2006.01)
*E01C 23/088* (2006.01)

(52) U.S. Cl.
CPC ..... *E01C 23/088* (2013.01); *E01C 2301/50* (2013.01)

(58) Field of Classification Search
CPC ..... E01C 23/088
USPC ..... 299/39.3, 39.1, 39.4, 81.2, 81.1, 81.3; 83/145, 146, 168, 346–349; 125/13.01, 125/12, 35
See application file for complete search history.

(56) References Cited

U.S. PATENT DOCUMENTS

| | | | | |
|---|---|---|---|---|
| 3,547,492 | A * | 12/1970 | Binger | 299/39.3 |
| 4,676,557 | A * | 6/1987 | Shope et al. | 299/39.3 |
| 5,161,910 | A | 11/1992 | O'Konek | |
| 5,354,146 | A | 10/1994 | O'Konek | |
| 7,073,975 | B2 | 7/2006 | Kraemer | |
| 7,837,276 | B2 | 11/2010 | Kraemer et al. | |

* cited by examiner

*Primary Examiner* — John Kreck
(74) *Attorney, Agent, or Firm* — Merchant & Gould P.C.

(57) ABSTRACT

A pavement diamond grinder used for grinding and/or grooving pavement surfaces as the grinder carriage with a rotating arbor supporting radio blades. A cooling and dust control system delivers water to the arbor. The system includes a spray bar with nozzles that atomizes the water prior to engagement with the blades. The system utilizes a wiper debris removal device to clean the blades. In addition, a device that is utilized to effect turbulence adjacent to the blades and improve contact of the atomized water with the blades.

5 Claims, 6 Drawing Sheets

WATER COOLING SYSTEM FOR GRINDER BLADES

BACKGROUND OF THE INVENTION

Field of the Invention

The present invention relates to a pavement diamond grinder and in particular to a grinder having a greatly reduced water flow for sawing and for blade cooling and dust control.

Description of the Prior Art

Pavement diamond grinders are well known and used for grinding concrete and asphalt surfaces. The grinding is performed for a variety of purposes, including removing irregularities in the road surface, to provide texture to the surface and to add antiskid properties. Moreover, grinding and grooving may be performed to groove the surface and facilitate water drainage. Grinding, texturing and grooving are used on pavement surfaces including highways, airport runways, bridge decks, industrial plants, stock pens and barns as well as other concrete or asphalt surfaces that may require a particular surface characteristic.

Typically, grinding is performed with diamond tipped blades that grind the concrete or asphalt and are mounted on a rotating arbor. The arbor is typically mounted on an under carriage of the grinder and is power supplied by the grinder. Such grinders typically require large power and great weight to achieve satisfactory grinding of hard materials.

In can be appreciated that the grinding and grooving process creates substantial amounts of debris, which is in the form of concrete dust and particles. In addition, the diamond tip blades generate substantial heat that requires cooling. Water is typically sprayed for cooling as well as dust control and lubrication in conventional grinders. Large amounts of water are currently sprayed at the blades on the arbor. This results in a dust-laden slurry that must be removed from the pavement surface. Suction is used to continually remove debris and water from the pavement in the area where grinding occurs. In some operations, the slurry may be simply left in the ditch on the side of the road. However, regulations now typically prohibit leaving the slurry and the grinding debris in the ditch. Therefore, it is necessary to collect the slurry and haul it elsewhere for disposal. Moreover, the large amount of water must be carried with the grinder and provisions must be made for hauling the slurry away. This requires additional equipment and also raises labor costs.

It can be seen that a new and improved grinder and grinding method are needed that provides for using substantially less water during grinding and that provides for simple and more convenient disposal of grinding byproduct.

SUMMARY OF THE INVENTION

The present invention is directed to a grinder. In one embodiment, the grinder is a pavement grinder that may be utilized for grinding pavement surfaces, grooving the pavement surfaces or cutting slots in the pavement. The grinder takes on a conventional configuration, such as shown by U.S. Pat. No. 5,354,146 for example, assigned to Diamond Surface, Inc. incorporated herein by reference. As with conventional grinders, the grinder includes a frame, drive wheels, a grinding carriage, an operator seat and controls, a motor and hydraulic fluid reservoir. The grinder may also include fuel and water tanks.

The grinding assembly includes an arbor with radial blades mounted thereon. Moreover, grinders other than pavement grinders may also be utilized and other blades may be utilized with the present invention. In one embodiment, the grinding assembly includes a sprayer assembly having a spray bar with one or more atomizing nozzles mounted thereto. The spray bar may be mounted on a track that arcs about a portion of a periphery of the axially mounted radial blades. The spray bar may be moved along the arcing mounting track so that it may be positioned at various locations relative to the grinder arbor. In addition, in some configurations multiple spray bars may be utilized for spraying at multiple positions on the periphery of the arbor.

The spray bar utilizes atomizing nozzles that provide an atomized mist directed at the arbor blades to provide cooling and dust control for the grinding operations. It has been surprisingly found that atomized mist, such as water provides greater efficiency as compared to the same volume of normally sprayed water for cooling. Therefore, much less water may be utilized as compared to conventional cooling and dust control systems.

To facilitate even greater cooling, an air manipulator may be utilized in some embodiments to improve the air flow around the arbor and blades so that a greater quantity of atomized air droplets contact the blades, thereby providing improved cooling. The air manipulator is generally mounted along the length of the blades. The air manipulator includes a block that is sufficiently soft to be cut into by the blades and maintain slots for the blades with portions extending between the blades for a close fit between the block of the air manipulator and the blades to reduce the turbulence surrounding the blades in the vicinity of the cooling mist. However, the block is sufficiently soft so that it does not have resistance to the arbor rotation and does not affect the efficiency of the grinding operation. A spring biases the block towards the blades but has a sufficiently small spring constant that it does not unduly affect the arbor's performance.

Moreover, in some embodiments, a cleaner is utilized to remove debris and water from the blades. The cleaner may also be configured as a substantially soft plastic block that may be self cutting by the blades of the grinder to maintain a close fit with notches formed to accept each blade and portions extending between the blades for improved cleaning. The cleaner may include a spring to maintain the cleaner in a favorable use position to maintain its effectiveness for removing the debris-laden slurry from the blades.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
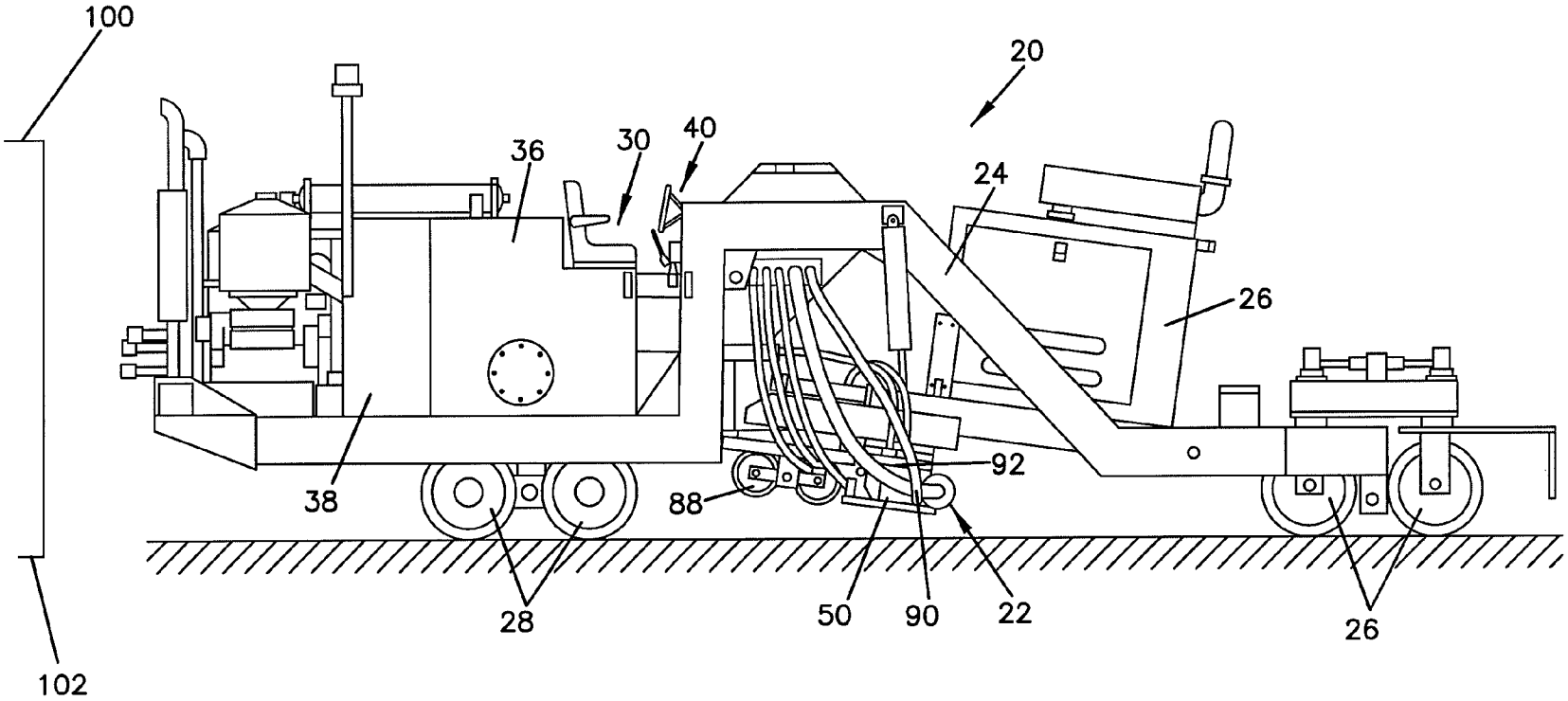
FIG. 1 is a side elevational view of a pavement grinder according to the principles of the present invention.
Figure 3:
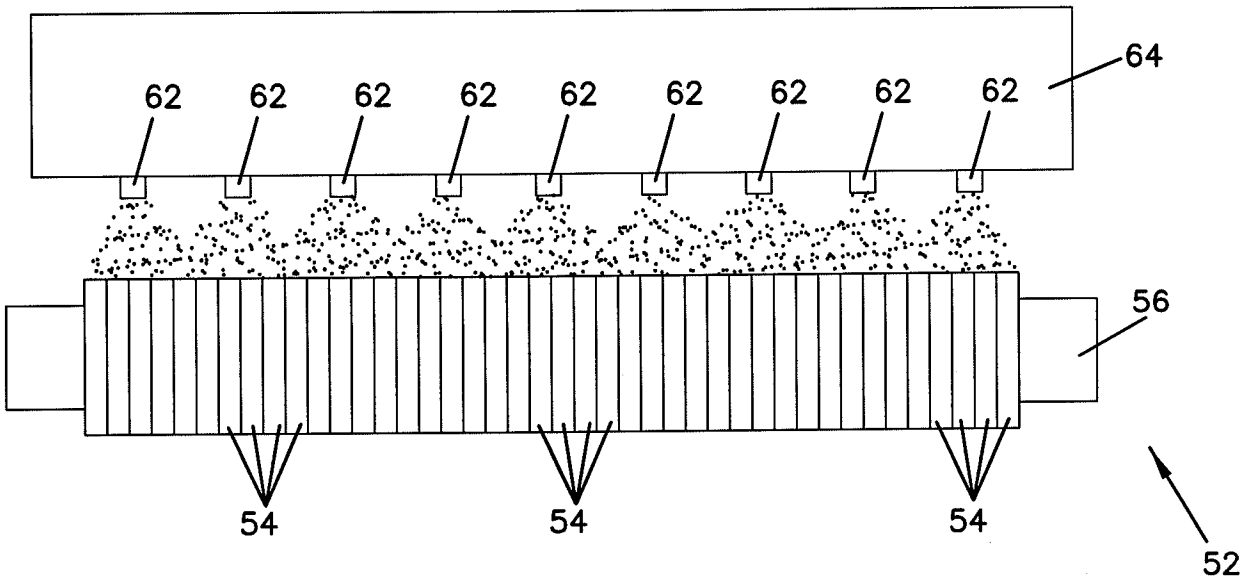
FIG. 3 is a sectional view taken along line 3-3 of FIG. 2.
Figure 4:
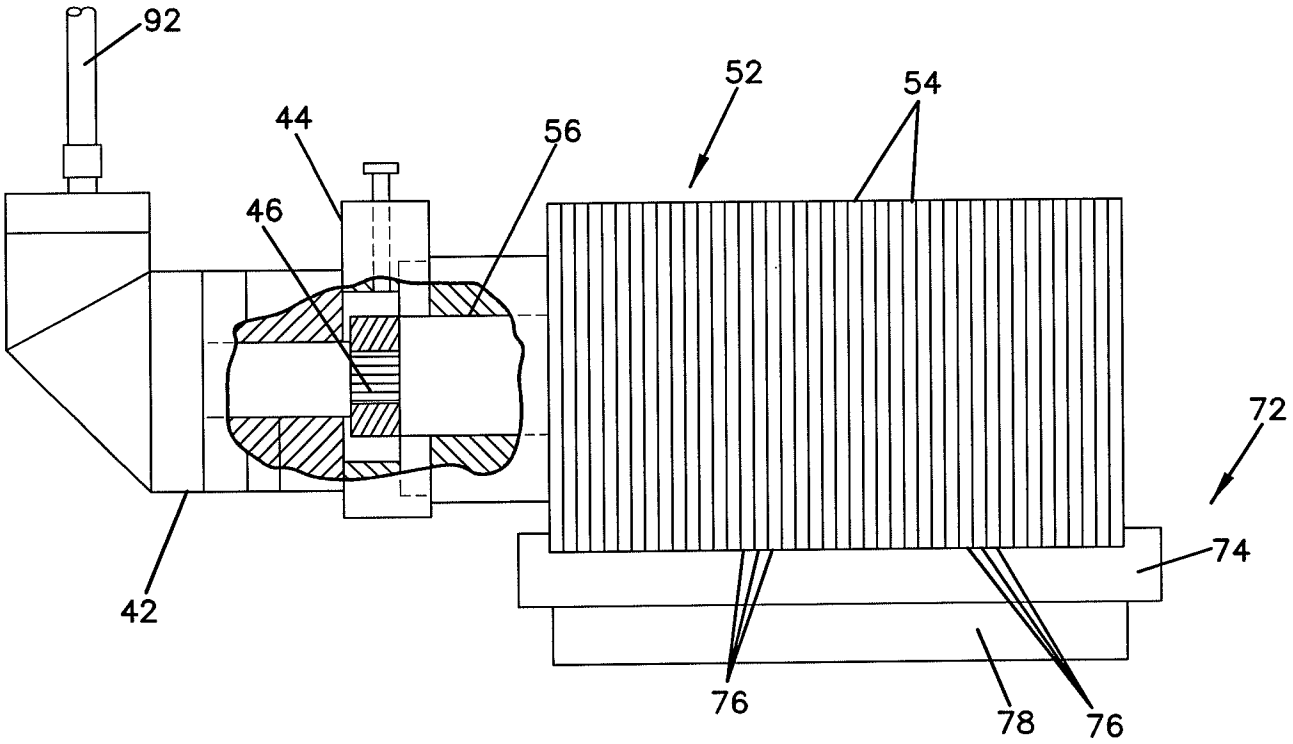
FIG. 4 is a sectional view taken along line 4-4 of FIG. 2.
Figure 5:
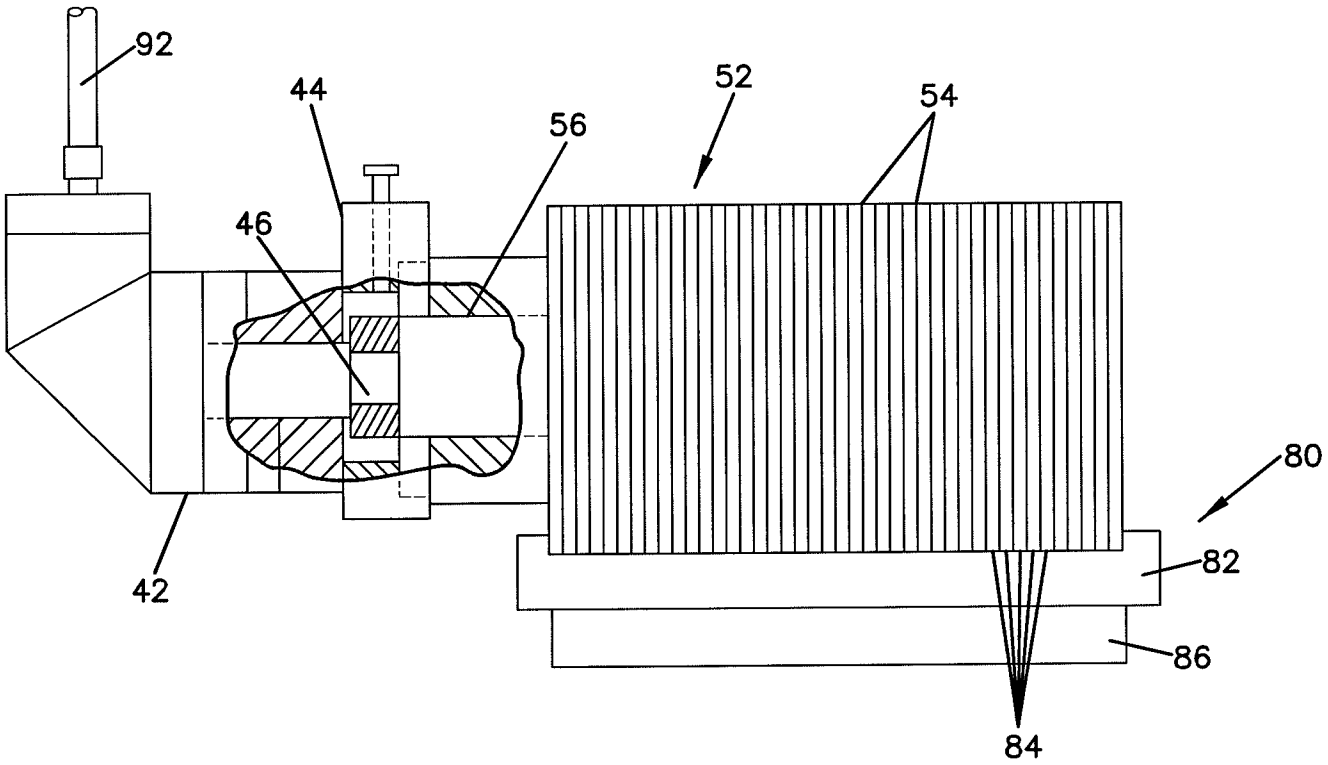
FIG. 5 is a sectional view taken along line 4-4 of FIG. 2.

Referring now to the drawings and in particular to FIG. 1, there is shown a grinder, generally designated 20. Grinder 20 includes a grinder assembly 22. The grinding assembly typically has a grinder carriage 50 with an arbor 52 having radial blades 54 mounted thereon, along the length of the arbor as shown in FIGS. 3-5. In addition, the grinding assembly 22 may take the form of grooving blades, a single blade for cutting slots in the pavement, or other configurations with radial blades that require cooling and/or dust control. In many conventional configurations, the arbor 52 may take on a variety of typical widths, generally extending from 2-4 feet.

Referring again to FIG. 1, the grinder 20 generally includes a frame 24 mounted on wheels 26 and 28. The frame 24 and the other components of the grinder provide sufficient mass for the forces needed for grinding relatively hard pavement surfaces. An operator seat 30 provides a clear view of the grinding operation area as well as access to controls 40. An engine 32 provides sufficient power to move the grinder 20 as well as provide power to drive the grinding assembly 22 by hydraulics and/or a series of pulleys. The grinder 20 generally has a hydraulic fluid tank 36 connected to hydraulic lines 92 for powering various components. Fuel tank 38 may be mounted at the rear of the frame 24. The grinder 20 may include a water tank 100 that is either towed, as shown diagrammatically in FIG. 1, or may be mounted directly on the frame 24. A collector 102 may be towed or incorporated at the rear of the frame 24. The collector 102 may be a sweeper, vacuum or other collector device to collect the slurry resulting from the grinding operations. As explained hereinafter, the present system uses substantially less water so that the collector 102 may be a smaller capacity device. Referring to FIGS. 3-5, the grinding carriage 50 includes an arbor 52 having diamond-tip radial blades mounted along the length of an arbor shaft along a grinding portion. Hydraulic motors 42 at each end of the arbor shaft provide power and are connected by a mounted assembly 44 and an adapter 46. The arbor 52 may also be driven by pulleys or other drive mechanisms that provide sufficient power and speed for pavement grinding or grooving.

Figure 2:
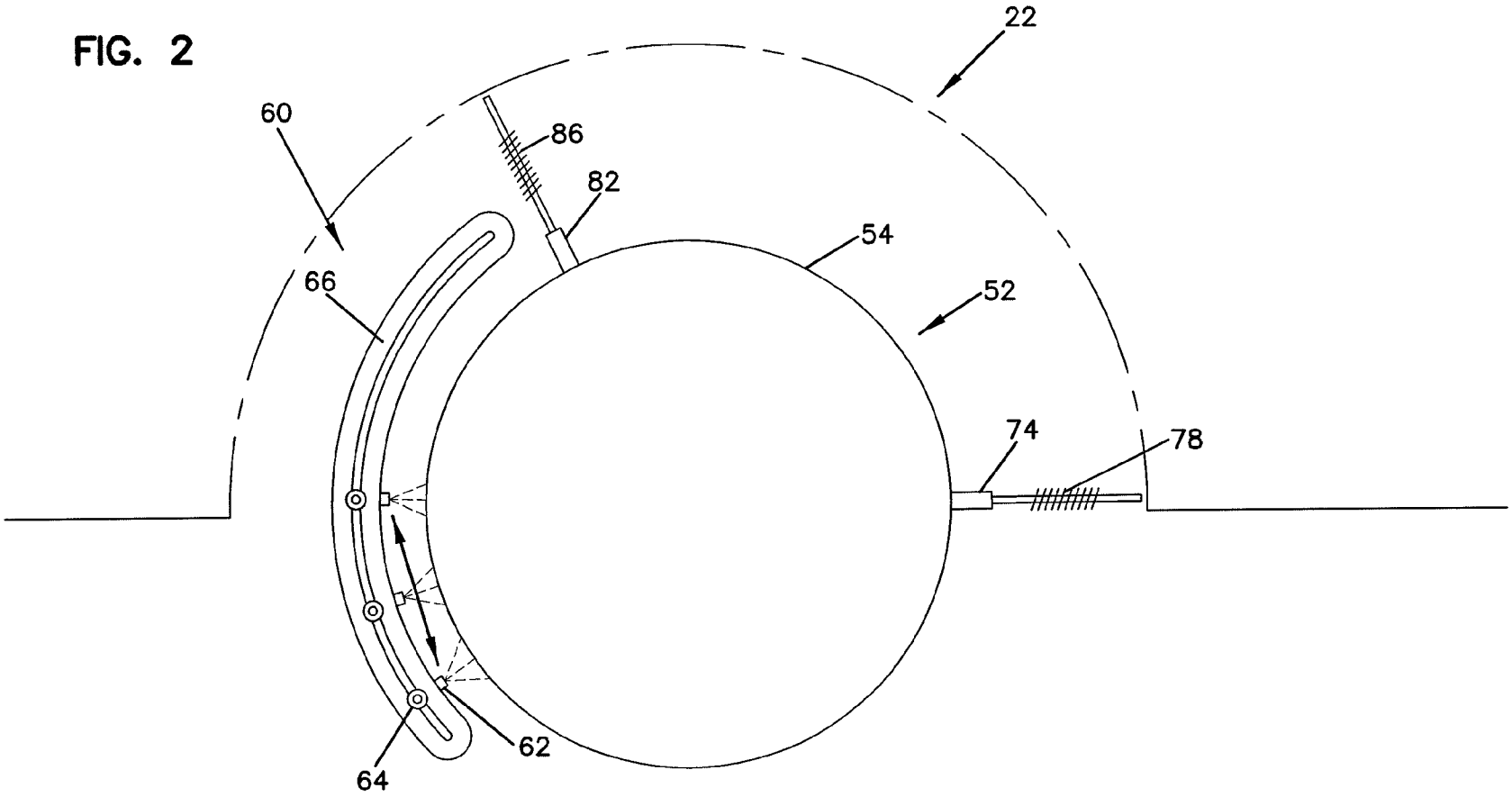
FIG. 2 is a side elevational view of a grinding assembly for the grinder shown in FIG. 1.
Figure 6:
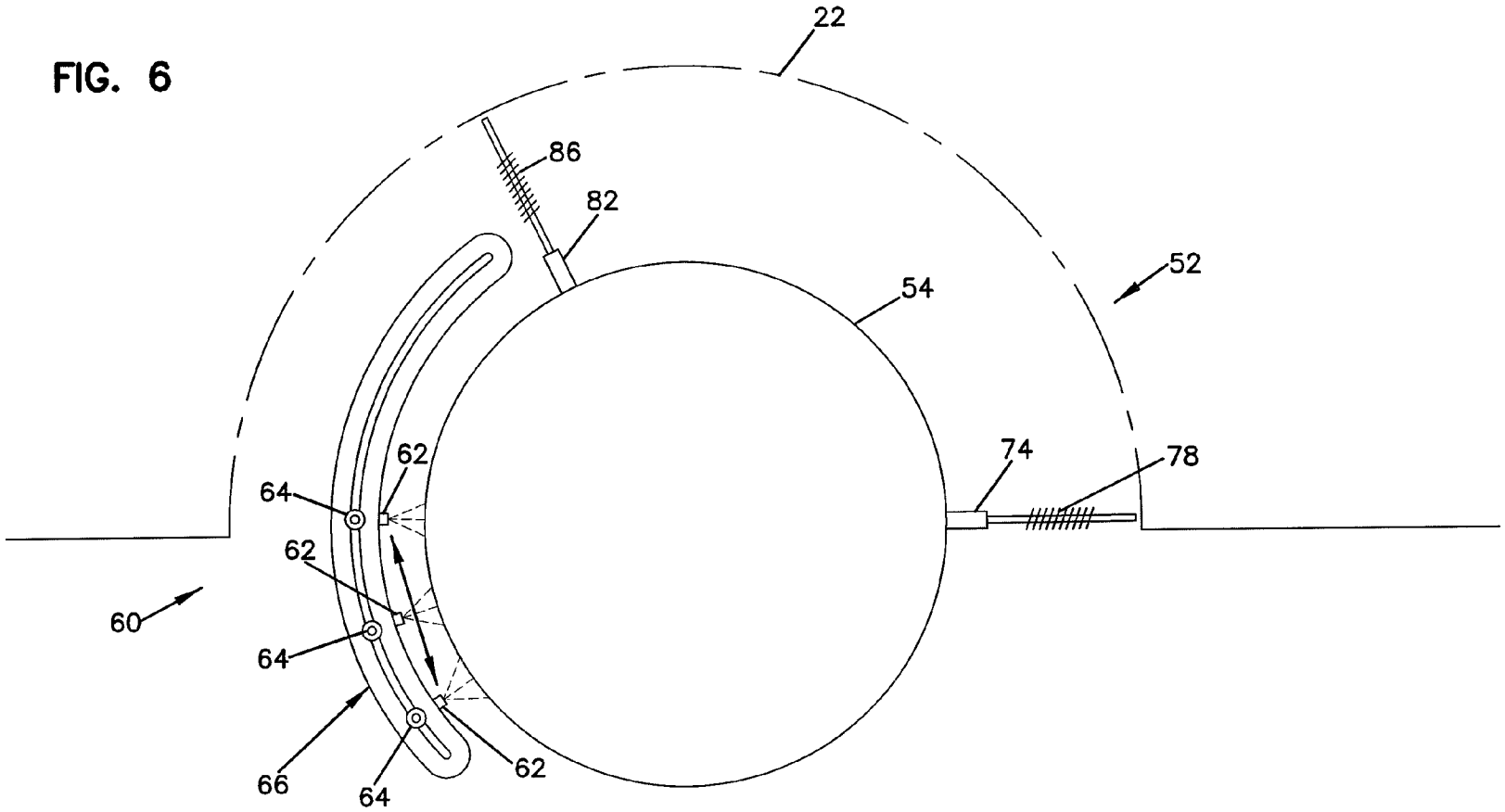
FIG. 6 is a side elevational view of a second embodiment of a grinding assembly for the grinder shown in FIG. 1.

As shown in FIG. 2, the grinding assembly 22 includes a sprayer assembly 60 that provides water for cooling and dust control. The sprayer assembly 60 includes a spray bar 64 mounted on an arcing track 66. The track 66 arcs outward from and about a portion of the periphery of the radial blades 54 so that nozzles may be positioned at different locations relative to the blades 54. In addition, as shown in FIG. 6, in one embodiment, the sprayer assembly 60 may include multiple spaced apart spray bars 64. Each of the spray bars 64 includes atomizing nozzles 62. The nozzles 62 atomize the cooling fluid directed to the radial blades 54 by atomizing the fluid prior to contact with the blades 54. It has been found that the amount of water used with the atomized system is decreased by 90% or more. Moreover, it has been surprisingly found that the cooling properties of the fluid mist provide much greater cooling efficiency for the same amount of water as compared to just a conventional spray that is not atomized. The atomized fluid also provides efficient dust control for the grinding operation. The resulting slurry has substantially less mass and volume than the slurry that may be collected using a conventional sweeper, vacuum or other collector 102, and disposed of in an environmentally safe manner. The use of the atomizing nozzles 62 substantially decreases the amount of material that must be disposed of and eliminates the need for a large cyclone separator.

In addition to using a sprayer assembly with atomizing nozzles, to improve the effectiveness of the atomizing spray, an air manipulator 80 is positioned above the sprayer assembly 60. As shown in FIGS. 2 and 5, the air manipulator 80 includes a block 82 in close contact with the radial blades 54. The block 82 is typically plastic or other relatively soft material that may be easily cut by the blades 54 to form a slot for each blade with the portions 84 extending between the blades for a close fit as the blades 54 rotate relative to the air manipulator 80. The block 82 is biased by a spring 86 towards the blades so that the tight contact is maintained and the manipulator 80 is self cutting. The spring 86 and the material of the block 82 are chosen so that the resistance to the rotation of the arbor 52 and blades 54 does not adversely affect performance, but is sufficient to maintain contact. The air manipulator 80 changes the air flow around the blades 54 and decreases turbulence so that a high percentage of the atomized fluid reaches the blades and provides improved cooling. It has been found that without the air manipulator 80, difficulties may arise due to the air flow proximate the blades 54 that decreases the amount of atomized fluid making sufficient contact with the blades and therefore, may not provide sufficient cooling. The air manipulator 80 improves the cooling performance of the sprayer assembly 60 while using much lower quantities of cooling fluid.

Referring to FIGS. 2 and 4, the grinding assembly 22 also includes a blade cleaner 70. A cleaner assembly 72 includes a block 74 and a spring 78. The cleaner assembly 72 contacts the tips of the blades 54 and removes the cleaning fluid laden with grinding dust and debris from the blades to improve the cutting performance. The cleaner assembly 72 has a block 74 that is sufficiently soft so that it will be cut by the blades 54 to form notches for receiving each blade through the block 74 having portions 76 extending between the blades to provide close contact with the blade surfaces. The block 74 is configured to wipe the material from the blades 54 during each revolution. The spring 78 biases the block 74 towards the blades 54 so that constant contact is maintained. The hardness of the block 74 and the force of the spring 78 are chosen so that sufficient force is maintained to keep the cleaner 72 in contact with blades 54, but is sufficiently small so that the performance of the grinding assembly 22 is not affected. The cleaning also improves cooling of the atomized mist through increases surface contact and provides for easily collecting the resultant slurry.

It can be further appreciated that the use of the sprayer assembly 60 along with the cleaner 72 and air manipulator 80 provides improved performance over conventional cooling systems that use large quantities of water and have large quantities of debris laden slurry that must be disposed in an environmentally safe manner. The present invention provides for much greater efficiency than is possible with the prior systems. The system of the present invention maintains the grinding assembly 22 and blades 54 at a sufficiently cool operating temperature. The present system also provides environmental advantages through improved disposal of the resultant slurry laden with debris than is possible with the prior art systems.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A pavement grinder device, comprising:

a rotating arbor;

a plurality of blades mounted along the arbor;

a fluid system supplying fluid; and an atomizer atomizing the fluid and spraying the atomized fluid on the blades; the atomizer comprising a spray bar adjustably mounted on an arcing track extending about a portion of a periphery of the blades.

2. A pavement grinder device according to claim 1, wherein the atomizer comprises a plurality of spray bars.

3. A pavement grinder device comprising:

a rotating arbor;

a plurality of blades mounted along the arbor;

a fluid system supplying fluid;

a fluid atomizer spraying atomized fluid on the blades; and a block biased toward the blades and removing debris from the blades.

4. A method of grinding pavement with a grinder apparatus having a rotating arbor with a plurality of blades mounted thereon, the method comprising:

moving the blades of the rotating arbor into engagement with the pavement;

directing fluid toward the blades;

atomizing the fluid prior to contacting the blades; and biasing a block against the blades of the rotating arbor and removing debris from the blades.

5. A method according to claim 4, further comprising manipulating air flow proximate the blades to provide greater contact between the atomized fluid and the blades.

* * * * *